US006188364B1

(12) United States Patent
Scordilis

(10) Patent No.: US 6,188,364 B1
(45) Date of Patent: Feb. 13, 2001

(54) MATCHED ANTENNA DEVICE AND A PORTABLE RADIO COMMUNICATION DEVICE INCLUDING A MATCHED ANTENNA DEVICE

(75) Inventor: Thierry Scordilis, Spånga (SE)

(73) Assignee: Allgon AB, Akersberga (SE)

( * ) Notice: Under 35 U.S.C. 154(b), the term of this patent shall be extended for 0 days.

(21) Appl. No.: 09/438,468

(22) Filed: Nov. 12, 1999

(30) Foreign Application Priority Data

Nov. 13, 1998 (SE) ..... 9803888

(51) Int. Cl.[7] ..... H01Q 1/24
(52) U.S. Cl. ..... 343/702; 343/895; 343/860
(58) Field of Search ..... 343/702, 895, 343/850, 725, 729, 853, 860; H01Q 1/24, 1/36

(56) References Cited

U.S. PATENT DOCUMENTS

| | | | | |
|---|---|---|---|---|
| 4,328,501 | | 5/1982 | DeSantis et al. | 343/749 |
| 5,335,368 | * | 8/1994 | Tamura | 343/702 |
| 5,973,646 | * | 10/1999 | Engblom | 343/702 |

FOREIGN PATENT DOCUMENTS

WO96/37007 11/1996 (WO) .
WO97/42680 11/1997 (WO) .
WO98/07208 2/1998 (WO) .

OTHER PUBLICATIONS

Abstract of Japanese Patent Appln. No. 06152221A, May 31, 1994, Matsushita Electric Ind. Co. Ltd.

* cited by examiner

*Primary Examiner*—Hoanganh Le
(74) *Attorney, Agent, or Firm*—Jacobson, Price, Holman & Stern PLLC

(57) ABSTRACT

A matched antenna device (1) for a radio communication device, comprising a matching means (3, 33) and a first antenna element (4). The matched antenna device (1) comprises a flexible dielectric substrate (2) carrying the matching means (3, 33) on a first side (21). The matching means (3, 33) comprises a conductive pattern (3), having a first coupling means (31) and a second coupling means (32), and exhibits inductive and capacitive characteristics. The flexible substrate (2) is to be attached to the radio communication device so as to capacitively couple the conductive pattern (3) to signal ground of the radio communication device. The first coupling means (21) is to be coupled to the circuitry of the radio communication device, and the second coupling means (32) is coupled to a feed portion (42) of the first antenna element (4).

26 Claims, 6 Drawing Sheets

MATCHED ANTENNA DEVICE AND A PORTABLE RADIO COMMUNICATION DEVICE INCLUDING A MATCHED ANTENNA DEVICE

FIELD OF THE INVENTION

The invention relates to a matched antenna device for a radio communication device, including a matching means and a first antenna element.

Further it relates to a radio communication device, including a matched antenna device.

RELATED ART AND BACKGROUND OF THE INVENTION

In a radio communication device the transmitting/receiving circuits are coupled to the feed point of a radiator means via a feed line. Normally, the transmitting/receiving circuits have a nominal impedance of 50+j0 ohm. If the impedance of the radiator feed point differs substantially from that of the transmitting/receiving circuits, an impedance matching means is required for matching the impedance of the radiator to the impedance of transmitting/receiving circuits.

The radiator and the impedance matching means may then be interconnected by a second feed line or similar having a given length. This feed line is influenced electromagnetically by different conductive or dielectric bodies in its surroundings, for example a support on which the radio device is resting, the hand and head of an operator, or the chassis of the radio device or conductive parts thereof. Especially when the radiator feed point impedance is high, the length of the second feed line is significant to the environmental influence on the antenna performance. The higher the impedance of the feed point and the longer the second feed line, the higher the sensitivity to environmental variations.

A radiator of quarter-wave type may not require an impedance matching means to be connected to 50 ohm circuitry. Sometimes, a quarter-wave radiator is preferred since it allows the antenna means to be relatively short and non-obstructive. However, a drawback of quarter-wave radiators, for example in cellular telephones, is that currents are inevitably generated on the chassis of the telephone. The antenna performance is then sensitive to influence by, for example, the operator holding the telephone or pressing it to his ear.

Also, from another point of view, it is desirable to use a radiator with relatively high impedance, for example a half-wave type radiator or similar. Generally, a half-wave type radiator provides a higher efficiency and a greater overall length resulting in less screening. Particularly, on a small size cellular telephone, screening by the operator's head is a problem with regard to operating range.

In WO-A1-97/42680 it is disclosed an antenna device for a portable radio communication device, where a radiating first element is substantially directly connected to the impedance matching means.

WO-A1-98/07208 discloses an integrated matched antenna assembly, having a matching circuit including an inductor formed on a substrate. A capacitive element having two conductors in spaced relation to each other is connected to the inductor by one of the conductors being arranged parallel to the inductor. This arrangement requires several conductive layers and at least two substrates. Further, wires can be used for connecting components of the matching device.

JP-A-6152221 discloses an antenna for mobile radio equipment. The antenna is connected to one terminal of a meandering transmission line whereof the other terminal is connected to ground, and a feed point is arranged on the transmission line. These arrangements are provided inside the telephone and require a feed line to the antenna feed portion, and discrete capacitive components.

WO-A1-96/37007 discloses an antenna apparatus, wherein a radiator is connected to one end of a spiral conductor of which the other end is connected to a transceiver. A drawback with this apparatus is that the spiral has one central and one peripheral connection. Further, a feed line is provided between a connecting portion of the spiral and the antenna.

Some general problems with matching devices or circuits are that they are space demanding, complicated to assemble and complicated to mount. Generally, the arrangements of the connections also cause problems. This is especially apparent when the matching device is located inside a radiotelephone housing, includes discrete components, or is not or can not be formed into a space optimising shape.

SUMMARY OF THE INVENTION

It is an object of the invention to obtain a matched antenna device, which requires less space inside a telephone, and which can use the available space better.

It is also an object of the invention to obtain a matched antenna device, which can be produced at low cost in a simple manufacturing process.

Another object of the invention is to provide a matched antenna device, which is suitable for production in large quantities.

These and other objects are attained by a matched antenna device according to the appended claims 1–25.

By the arrangement of a matching means including a conductive pattern on a flexible substrate, it is obtained a matching means which can be attached to a radiotelephone and easily be formed so as to adapt to the available space or surface.

By arranging a matched antenna device according to claim 1, it is achieved an antenna device which provides for simple connection.

By the arrangement of two antenna elements, an antenna device which is operable in multiple bands is obtained.

By arranging coupling means in end portions of the conductive pattern or matching pattern, it is obtained an efficient matching means having simple connections.

By arranging coupling means to be located essentially on an envelope of the conductive pattern or matching pattern, it is achieved an efficient matching means having simple connections.

By arranging the conductive pattern or matching pattern so that it includes a meander shaped portion, it is obtained an efficient matching means.

By arranging the conductive pattern or matching pattern on the same side of a substrate as a radiating conductive pattern, it is obtained an efficient matched antenna device having essentially no feed line between the matching means and the antenna element. It is also achieved an antenna device which is simple to connect, and simple to manufacture at low cost.

By the arrangement of an extendable/retractable antenna element, it is achieved an efficient antenna device for operation in stand by mode and talk mode.

By the arrangement of a conductive surface separated from the conductive pattern or matching pattern by a dielectric substrate, it is achieved an efficient matching means which easily can be adjusted for matching within desired frequency ranges.

DESCRIPTION OF PREFERRED EMBODIMENTS

Figure 1A:
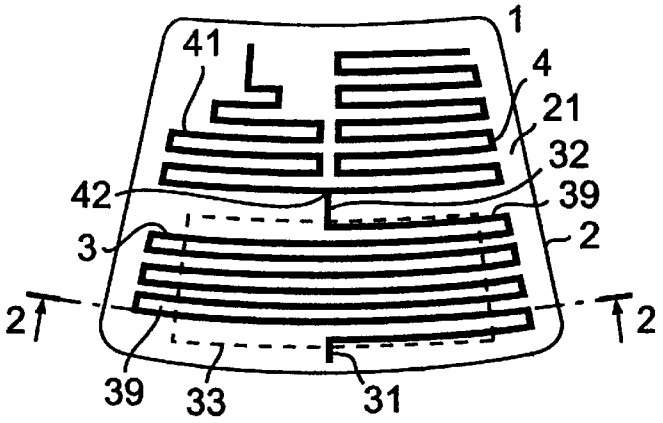
FIG. 1*a* shows a first embodiment of a matched antenna device according to the invention.

Referring to FIG. 1*a*, a first embodiment of the invention concerning a matched antenna device, generally denoted 1, is shown. The antenna device is particularly intended for a radio communication device, such as a mobile telephone. A flexible dielectric substrate 2 is provided, having on its first side 21, a conductive pattern or matching pattern 3. This pattern 3 is arranged on the substrate 2 in a meander shape, and exhibits a first coupling means 31 which is arranged to be connected to transceiver circuits of a radio communication device. At a side of the meandering pattern opposite to that of the first coupling means, the meandering pattern is provided with a second coupling means 32, which is connected to a feed portion 42 of a first 4 and a second 41 antenna element. Also the antenna elements 4 and 41 are conductive meander patterns arranged on the first side 21 of the substrate 2. Although two antenna elements are shown according to this embodiment, it is possible to have only one antenna element, or more than two antenna elements arranged on the substrate according to different variants of the invention. It is not necessary, but preferable that the antenna element(s) 4, 41 is (are) arranged on the same substrate as the conductive pattern 3. If arranged on different substrates, the coupling means 32 is connected to the feed portion 42 by a conductive or capacitive coupling means.

Figure 1B:
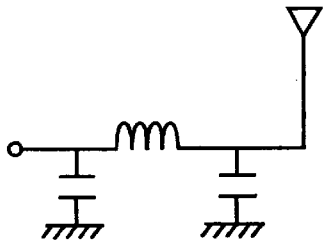
FIG. 1*b* shows an equivalent circuit diagram of a matched antenna device, as shown in FIG. 1*a*.

The conductive meandering pattern 3 exhibits capacitive and inductive characteristics, as shown in the equivalent circuit diagram shown in FIG. 1*b*. It exhibits an impedance at the first coupling means 31 being 50 ohm, and provides matching between the antenna element(s) and the transceiver circuits of the radio communication device. Other impedances than 50 ohm can be selected, if desired.

By flexible substrate is meant a plastic substrate having no (glass)fibre reinforcement. Further, it should be possible to bend the flexible substrate around a cylindrical frame having a diameter less than one centimetre. Preferably, it should be possible to bend the flexible substrate to form edges or bend it with bending radii as small as one millimetre. A plastic film such as a flex-film is preferred as flexible substrate.

Figure 2A:
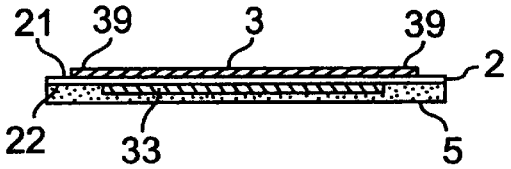
FIG. 2*a* is a cross section taken at 2—2 in FIG. 1*a*.

In FIG. 2*a* a cross section of the antenna device of FIG. 1*a*, taken at 2—2, is shown. Here it is seen that a conductive foil or surface 33 is arranged on the second side 22 of the flexible substrate, which also is indicated by broken lines in FIG. 1*a*. The conductive surface 33 covers an area corresponding to the matching meander 3 (the conductive pattern), except for the curved portions and their vicinities indicated by 39. This surface serves as a ground plane, and is preferably connected to signal ground of the radio communication device by means of a conductive or capacitive coupling device. The conductive surface is not necessary for the function of the matching meander, but its presence is preferred. However, if the conductive foil or surface 33 is omitted, some other capacitive components should be introduced e.g. stray capacitances coupled to signal ground. It is also a possible alternative to provide a carrying structure, to which the flexible substrate is attached, with a conductive foil or surface having preferably similar overlap with the conductive pattern 3, and function as the conductive foil or surface 33. The conductive foil or surface is preferably coupled to signal ground of the radio communication device conductively or capacitively.

Further, an adhesive 5 is arranged on the second side of the substrate 2. It can be an double sided tape or another type of adhesive, e.g. as is used for labels or stickers. Alternatively, as shown in FIG. 2*b*, the adhesive could be provided on the first side of the substrate, and covering the conductive pattern 3 and the antenna elements 4, 41.

Figure 2B:
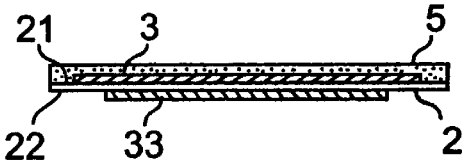
FIG. 2*b* is an alternative cross section taken at 2—2 in FIG. 1*a*.

For clarity the layers in FIGS. 2*a* and 2*b* are depicted to be thicker than they really are, in relation to other dimensions.

In FIG. 1*b* an equivalent circuit diagram of the antenna device in FIG. 1*a* is shown. The values of inductive and capacitive components depend on the shape of the conductive pattern 3 and the conductive foil or surface 33. Therefore, tuning is performed by shaping the conductive pattern 3 and the conductive foil or surface 33, in order to achieve the desired values. Those values also depend on the frequency, since the components are distributed. This dependence has the result that matching is achieved at various frequencies.

Figure 3A:
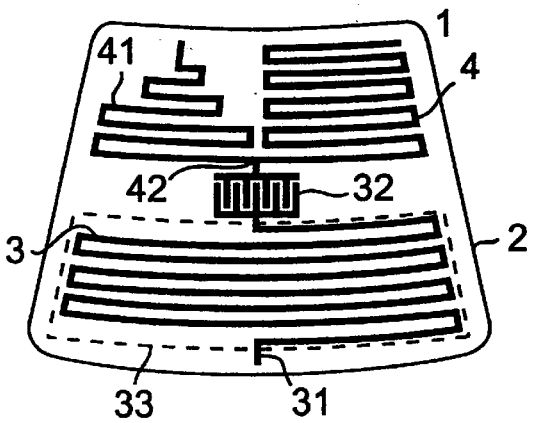
FIG. 3*a* shows a second embodiment of a matched antenna device according to the invention.

In FIG. 3*a* a second embodiment of the invention is shown. It differs from the embodiment of FIG. 1*a* essentially in that the second coupling means 32 is a capacitive coupling device, and that the conductive surface has another coverage. The first coupling means 31 is preferably connected to the transceiver circuits of the radio communication device conductively, e.g. by a contact device connected to a feed line, or directly to a PCB (printed circuit board) of the circuitry of the radio communication device. Alternatively a capacitive coupling can be employed. The second coupling means 32 is a interdigit capacitor. The conductive surface (33) covers an area somewhat larger than an area corresponding to the conductive pattern 3, with the areas for the coupling means excluded. It could cover an area corresponding to an envelope of the conductive pattern 3, again, with the areas for the coupling means 34 excluded. The envelope is a curve touching every curve of the meander pattern. Since the coupling means are included in the pattern they are included in the envelope.

Figure 3B:
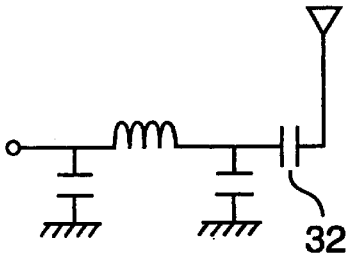
FIG. 3*b* shows an equivalent circuit diagram of a matched antenna device, as shown in FIG. 3*a*.

In FIG. 3*b* an equivalent circuit diagram of the antenna device in FIG. 3*a* is shown. It is similar to the diagram shown in FIG. 1*b*, except for the capacitive coupling to the antenna element.

Figure 4A:
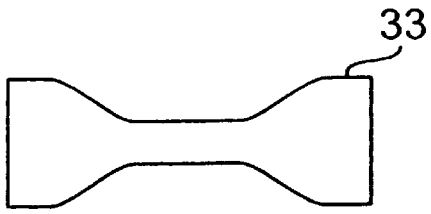
FIGS. 4*a*–*d* show alternative shapes of the conductive foil or surface in the matched antenna device according to the invention.
Figure 4B:
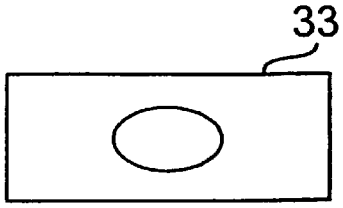
Figure 4C:
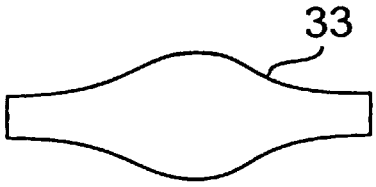
Figure 4D:
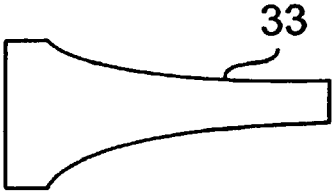

In order to achieve the desired characteristics for the matching means including the conductive pattern or matching pattern 3, the conductive foil or surface 33, which also is included in the matching means, when present, can be formed in other shapes than those described above, whereof some possible shapes are shown in FIGS. 4*a–d*. In FIG. 4*a*, the conductive foil or surface 33 has the shape of a planar projection of an hourglass. In FIG. 4*b* the shape is that of a rectangle with a central hole. In FIG. 4*c* the shape can be described as a band exhibiting an elliptic extension at its central portion. In FIG. 4*d* the shape is like a planar projection of a funnel. Also other shapes or patterns are possible.

Figure 5:
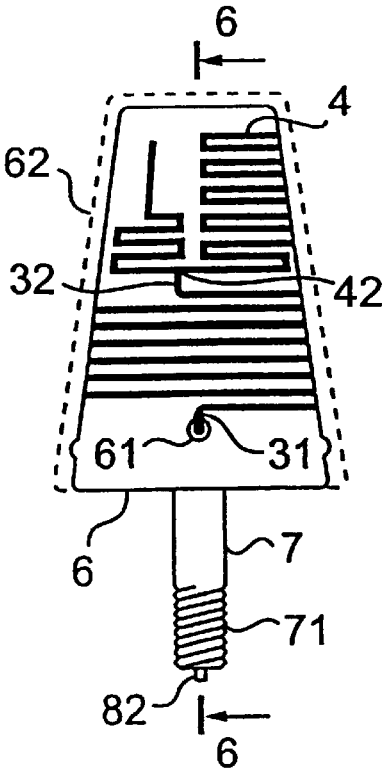
FIG. 5 shows a matched antenna device according to the invention provided on a carrying structure.

Referring to FIG. 5, it is shown how a matched antenna device 1 is provided on a carrying structure or support 6. The support 6 is preferably made of an insulating material, and is elongated, preferably having essentially circular or elliptical cross section. It can also be described as frustum of a cone. In this embodiment the support is a frame of a type similar to those used to support antenna elements for some types of telephones using stub antennas, and which are mounted on a telephone chassi. The antenna device 1 is wound around the support 6, and fastened thereto by means of said adhesive 5. The size and shape of the antenna device 1 is such that it essentially covers the support 6, and it is intended to be applied in one turn around the support 6 without overlap. The support 6 is provided with a hole 61 through which the coupling means 31 can be introduced for further connection with a signal conductor or feed line 82. The antenna device is protected by a cover 62 made of an insulating material (depicted with broken lines). The assembled antenna device is mounted to a radio communication device by means of a fitting 7, preferably provided with a threaded portion 71, which is received by a corresponding part in or on the radio communication device. Alternatively, the antenna device can be attached by snap action devices. The fitting 7 or the snap action devices can be made of conductive or insulating material. The signal conductor or feed line 82 is connected to the circuitry of the radio communication device by direct contact or by means of a connection device.

Figure 6:
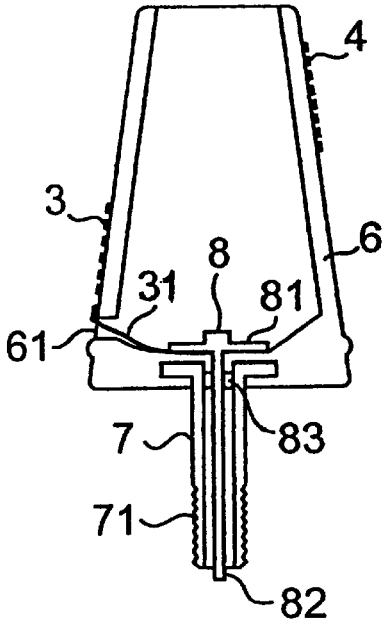
FIG. 6 is a section taken at 6—6 in FIG. 5.

FIG. 6 shows a section taken at 6—6 in FIG. 5. A conductive pin 8 provided with a head 81 is used for making contact with the coupling means 31, and serves as signal conductor or feed line 82. The pin is locked with locking members 83, and a pressure is created between the head 81 and the bottom of the chamber in the support 6, so that the coupling means 31 is secured therebetween.

Figure 7:
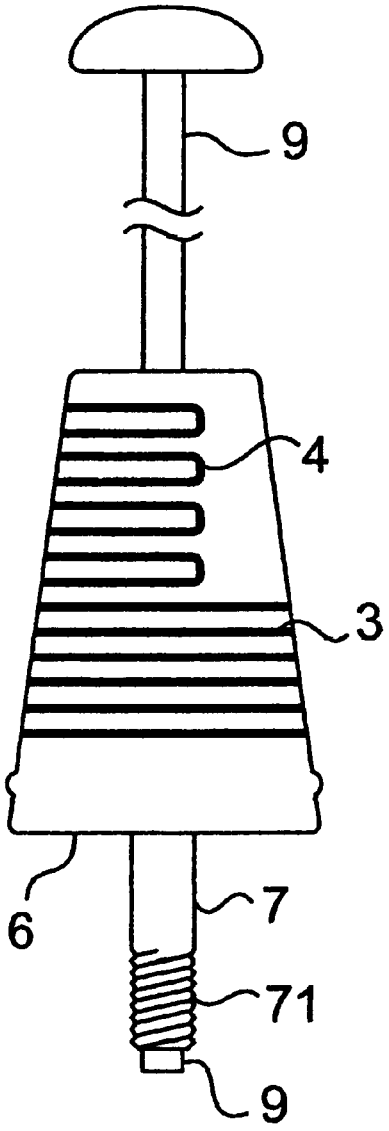
FIG. 7 shows an embodiment of the invention, where an antenna rod is arranged to be slidable and at least partially encompassed by a matching means and an antenna element.

In FIG. 7 it is shown an embodiment of the invention, where an antenna rod 9 is arranged to be slideably movable, through the support 6, between an extended and a retracted position. In this case the fitting 7 is not filled with an insulating material so that the rod can slide therethrough. The fitting 7 is preferably made of a conducting material and the coupling means 31 is connected to the fitting, which is to be connected to the circuitry of the radio communication device.

Figure 8:
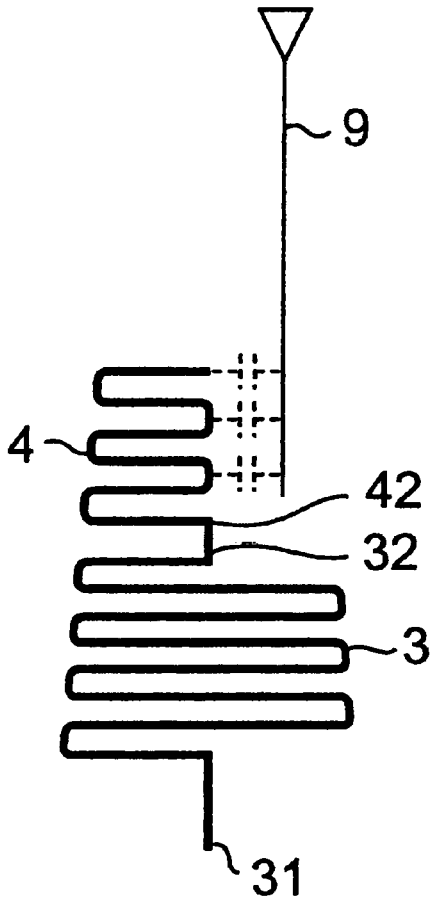
FIG. 8 shows diagrammatically an arrangement for the feeding of the antenna rod in FIG. 7.

The antenna rod 9 can be fed in different ways, whereof one is shown in FIG. 8. The antenna rod includes a conductive rod provided with an insulating cover. Preferably a top portion, essentially with the same length as the extension of the antenna element 4 in a direction parallel with the antenna rod 9, of the antenna rod 9 is made of insulating material only. In FIG. 8 it is shown that the antenna rod is coupled capacitively, with its conductive portion to the antenna element 4, preferably to the top portion thereof, when the rod antenna 9 is in its extended portion.

Figure 9:
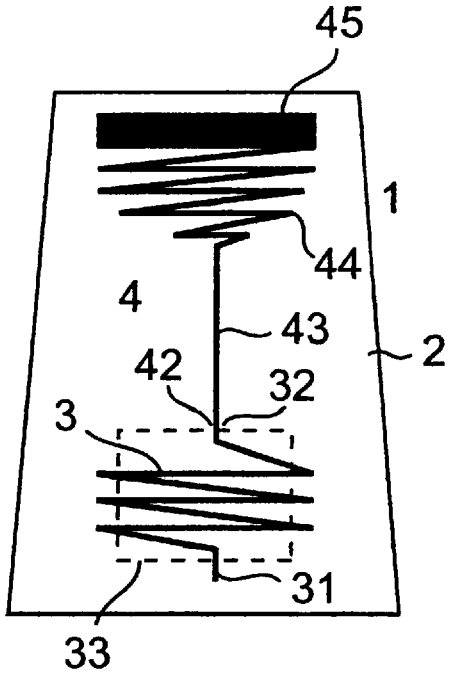
FIG. 9 shows a further embodiment of a matched antenna device according to the invention.

In the embodiment of the invention shown in FIG. 9, the second coupling means 32 is coupled to the feed portion 42 of the antenna element or radiating pattern 4. This antenna element comprises a straight portion 43, a meandering portion 44 and a top capacitance 45, which includes a metallic strip 45. By arranging the straight portion, the radiating parts will be more separated from the phone and the matching means, which can be advantageous.

Figure 10:
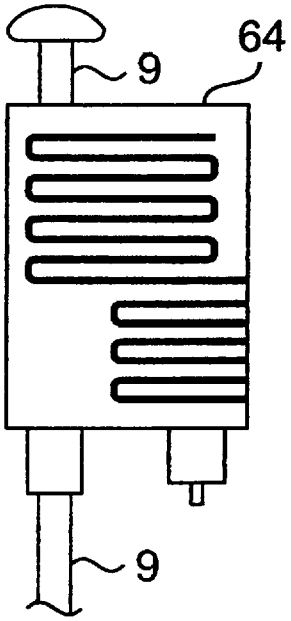
FIG. 10 shows a further embodiment of the invention, where a antenna rod is arranged to be slidable and at least partially encompassed by an antenna element.
Figure 11:
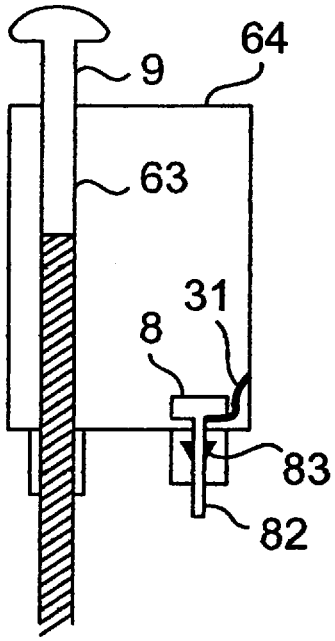
FIG. 11 is a section of the embodiment shown in FIG. 10, taken in a plane parallel with the paper in FIG. 10.

In FIG. 10 it is shown a further embodiment of the invention, where an antenna rod 9 is arranged to be slideably movable, through the support 64, between an extended and a retracted position. In FIG. 11, which is a cross sectional view of the device of FIG. 10, it is shown that the antenna rod is slidably arranged in a channel 63, arranged in the support 64. A conductive pattern 3 and at least a conductive radiating pattern 4 are arranged on the support 64. Preferably a conductive foil or surface 33 is provided under the conductive pattern 3, as described in connection with the embodiments above. The connection of the conductive pattern 3 and the conductive radiating pattern 4 is arranged separated from the opening for the antenna rod 9. The connection pin 8 is connected with the first coupling means 31 in a similar way as described above, even if other ways are possible. The signal conductor or feed line 82 is surrounded by insulating material, but not necessarily a conductive fitting as described in previous embodiments. Instead a conductive part or attachment belonging to the telephone housing can form an outer conductor of a coaxial feed line.

Figure 12:
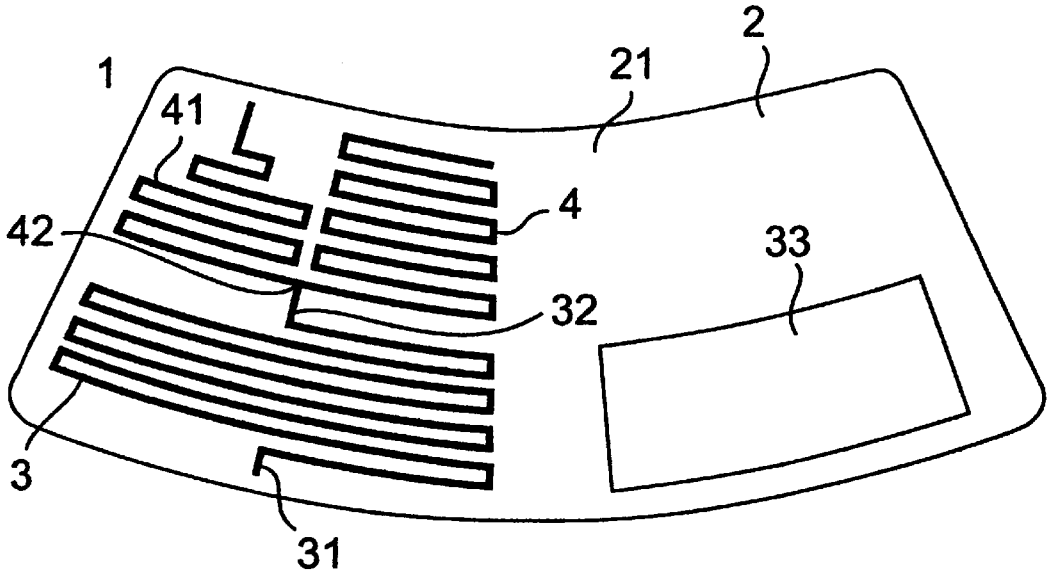
FIG. 12 shows an embodiment of a matched antenna device according to the invention which is to be applied on a support with overlap.

In FIG. 12 an alternative embodiment of the invention is shown. The substrate 2 has a width essentially twice that of the substrates 2 shown in FIGS. 1*a* or 3*a*. Here the substrate 2 is provided on its first side 21 with a conductive pattern or matching pattern 3, a first coupling means 31, a second coupling means 32, a feed portion 42, a first 4, and a second 41 antenna element, as described above. Those are provided on the left hand half of the substrate. On the first side 21 of the other half a conductive foil or surface 33 is arranged. The substrate is further provided on its second side (back side) with an adhesive, as described above, in connection with the previous embodiments. Alternatively the adhesive can be provided on the first side, as described above. When applied on a carrying structure or support, the substrate is wound around the support with overlap, so that it will be applied with two turns. Thus the conductive pattern 3 will be located over or under the conductive foil or surface 33. The connections, the function, and the form of the conductive foil or surface 33 can be the same as described above.

Figure 13:
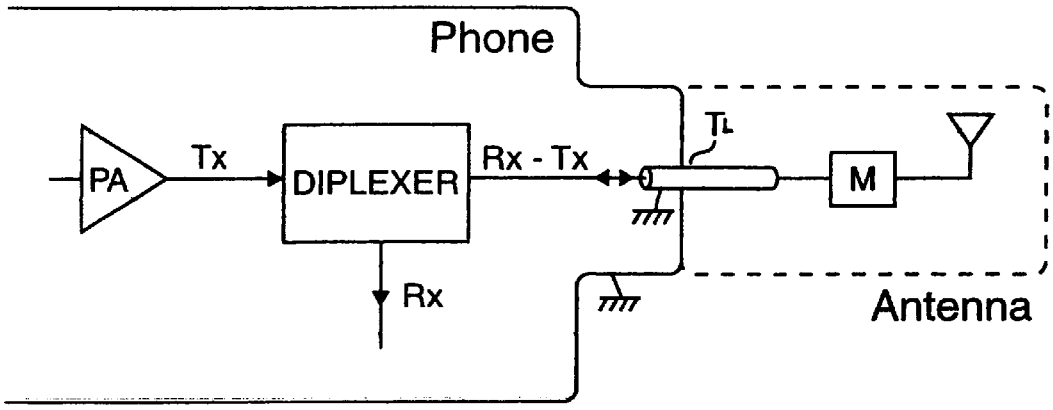
FIG. 13 shows schematically how the matched antenna device according to the invention can be provided on a mobile telephone.

FIG. 13 shows schematically how the matched antenna device according to the invention can be provided on a mobile telephone. As seen, the signals to be transmitted $T_x$ and the received $R_x$ signals are fed to and from a diplexer, respectively. The signals from/to the diplexer are transmitted via a transmission line to/from the matching means M (corresponding the conductive pattern or matching pattern 3, and the conductive foil or surface 33, when present, as described above). As seen the transmission line $T_L$ crosses the border between the telephone and the antenna device. The transmission line $T_L$ preferably is a coaxial transmission line, but could be any kind of non-radiative transmission line. Such a transmission line could for example be a microstrip line, pair conductor or single conductor, having a specific impedance, preferably 50 ohm. A portion of the outer conductor of the transmission line $T_L$ can belong to the antenna, e.g. be formed by a part of a fitting. Alternatively, this portion can be formed by a conductive part or an attachment belonging to the telephone housing, e.g. a screw threaded portion.

The transmission line can also be divided into two parts, one for the antenna device and on for the phone itself. The latter includes the last track of the PCB (pattern of the PCB between diplexer and the antenna connector) and the antenna connector. The antenna connector is preferably located on the PCB.

In the embodiments described above, the conductive patterns 3 and the conductive radiating patterns 4, 41 may be formed by initially plating the surface of the flexible substrate 2 with a metallic layer, and then selectively etching away the layer to expose the flexible substrate 2 according to a pattern applied in a photographic layer similar to that used for etching printed circuit boards. Alternatively the metallic material may be applied by selective deposition or by printing techniques.

Although the invention is described by means of the above examples, naturally, many variations are possible within the scope of the invention. For example the matched antenna device or parts thereof can be arranged inside a telephone, though only mounting outside has been described.

What is claimed is:

1. A matched antenna device (1) for a radio communication device, comprising a matching means (3, 33) and a first antenna element (4), wherein the matched antenna device further comprises a flexible dielectric substrate (2) having a first side (21) and a second side (22), the matching means (3, 33) comprises a conductive pattern (3), having a first coupling means (31) and a second coupling means (32), and exhibiting inductive and capacitive characteristics, arranged on the first side (21) of the flexible substrate (2)

a signal ground conductive surface being capacitively coupled to the conductive pattern (3), the first coupling means (21) is to be coupled to the circuitry of the radio communication device, the first antenna element (4) having a first end and a second end, a feed portion (42) being arranged at the first end, and the second coupling means (32) being coupled to the feed portion (42) of the first antenna element (4).

2. The matched antenna device according to claim 1, wherein the flexible substrate (2) is arranged on a carrying structure, and the first coupling means (31) is connected to a signal conductor of a transmission line whereof at least a portion of a ground conductor is constituted of a conductive fastening means, for fastening the carrying structure to the radio communication device, said fastening means encompassing the signal conductor.

3. The matched antenna device according to claim 1, wherein the first coupling means (31) is connected to one end of a transmission line, of which the other end is arranged to be connected to transceiver circuits of the radio communication device and exhibits an impedance matched to said transceiver circuits.

4. The matched antenna device according to claim 1, wherein each of the first coupling means (31) and the second coupling means (32) are included in a respective end portion of the conductive pattern (3).

5. The matched antenna device according to claim 1, wherein each of the first coupling means (31) and the second coupling means (32) are located essentially on an envelope of the conductive pattern (3).

6. The matched antenna device according to claim 1, wherein the conductive pattern (3) includes a meander shaped portion.

7. The matched antenna device according to claim 1, wherein the first coupling means (31) provides conductive coupling.

8. The matched antenna device according to claim 1, wherein the second coupling means (32) provides capacitive coupling.

9. The matched antenna device according to claim 1, wherein the second coupling means (32) provides conductive coupling.

10. The matched antenna device according to claim 1, wherein the first antenna element (4) includes a radiating conductive pattern (4) being arranged on the first side (21) of the flexible substrate (2).

11. The matched antenna device according to claim 10 further comprising a second antenna element (41), wherein the second antenna element (41) including a radiating conductive pattern (41) arranged on the first side (21) of the flexible substrate (2), and having a feed portion (42) connected to the feed portion (42) of the first antenna element (4).

12. The matched antenna device according to claim 1 further comprising a third antenna element (9), wherein the third antenna element (9), being extendable/retractable, is arranged to be coupled to the circuitry of the radio communication device when in its extended position, and the flexible substrate (2) is arranged to at least partially encompass the third antenna element (9) when in an extended position.

13. The matched antenna device according to claim 12, wherein the third antenna element (9) is coupled capacitively to the first antenna element (4).

14. The matched antenna device according to claim 12, wherein the third antenna element (9) is coupled capacitively to the second coupling means (32).

15. The matched antenna device according to claim 1, wherein at least a portion of the second side (22) of the flexible substrate (2) is provided with a conductive surface (33).

16. The matched antenna device according to claim 15, wherein the conductive surface (33) covers an area of the second side (22) of the flexible substrate (2) essentially corresponding to and overlapping the area of an envelope of the conductive pattern (3).

17. The matched antenna device according to claim 15, wherein the conductive surface (33) covers a region of the second side (22) of the flexible substrate (2) essentially included in a region corresponding to and overlapping the area of an envelope of the conductive pattern (3), and the conductive surface (33) has one of the shapes included in the group consisting of: a rectangle, a rectangle with a central hole, a planar projection of an hourglass, a planar projection of a funnel, and a band exhibiting an elliptic extension at its central portion.

18. The matched antenna device according to claim 15, wherein the conductive pattern (3) includes a meander shaped portion, and the conductive surface (33) covers an area of the second side of the flexible substrate essentially corresponding to and overlapping the area of the meander shaped portion excluding areas (39)surrounding and including curved portions of the meander shaped portion.

19. The matched antenna device according to claim 15, wherein the conductive surface (33) is arranged to be capacitively coupled to signal ground of the radio communication device.

20. The matched antenna device according to claim 15, wherein the conductive surface (33) is arranged to be conductively coupled to signal ground of the radio communication device.

21. The matched antenna device according to claim 1, wherein at least a portion of the first side (21) of the flexible substrate (2), which portion is separated from the conductive pattern (3) is covered with a conductive surface (33), and said substrate (2) is to be applied to a carrying structure so that portions of the conductive surface (33) and the conductive pattern (3) overlap.

22. The matched antenna device according to claim 1, wherein an adhesive (5) is provided on one side (21, 22) of the flexible substrate (2), in order to facilitate the attachment of the flexible substrate to a carrying structure (6).

23. The matched antenna device according to claims 22, wherein the carrying structure (6) has an essentially cylindrical shape.

24. The matched antenna device according to claim 1, wherein the flexible substrate (2) is bent around a longitudinal axis so as to exhibit a curved shape in at least a plane perpendicular to the flexible substrate.

25. The matched antenna device according to claim 1, wherein the flexible substrate is arranged on a carrying structure, and the carrying structure is arranged to be mounted to a housing of the radio communication device, so that at least a major part of the matched antenna device will be located outside the housing of the radio communication device.

26. A portable radio communication device, wherein it is provided with a matched antenna device (1) comprising a matching means (3, 33) and a first antenna element (4), a flexible dielectric substrate (2) having a first side (21) and a second side (22), the matching means (3, 33) comprises a conductive pattern (3), having a first coupling means (31) and a second coupling means (32), and exhibiting inductive and capacitive characteristics, arranged on the first side (21) of the flexible substrate (2), a signal ground conductive surface being capacitively coupled to the conductive pattern (3), the first coupling means (21) is to be coupled to the circuitry of the radio communication device, the first antenna element (4) having a first end and a second end, a feed portion (42) being arranged at the first end, and the second coupling means (32) being coupled to the feed portion (42) of the first antenna element (4).

* * * * *